US008043517B2

(12) United States Patent
Gu et al.

(10) Patent No.: US 8,043,517 B2
(45) Date of Patent: Oct. 25, 2011

(54) METHOD OF FORMING OPENINGS IN SUBSTRATES AND INKJET PRINTHEADS FABRICATED THEREBY

(75) Inventors: Jianhui Gu, Singapore (SG); Rio Rivas, Corvallis, OR (US); Jeremy Harlan Donaldson, Corallis, OR (US); Bernard A Rojas, Singapore (SG)

(73) Assignee: Hewlett-Packard Development Company, L.P., Houston, TX (US)

( * ) Notice: Subject to any disclaimer, the term of this patent is extended or adjusted under 35 U.S.C. 154(b) by 1542 days.

(21) Appl. No.: 11/229,825

(22) Filed: Sep. 19, 2005

(65) Prior Publication Data

US 2007/0064060 A1 Mar. 22, 2007

(51) Int. Cl.
*B41J 2/16* (2006.01)

(52) U.S. Cl. ..... 216/27; 216/83; 216/87; 216/95; 216/96; 216/99

(58) Field of Classification Search ..... None
See application file for complete search history.

(56) References Cited

U.S. PATENT DOCUMENTS

| | | | | |
|---|---|---|---|---|
| 5,463,413 | A | 10/1995 | Ho et al. | |
| 5,734,399 | A | 3/1998 | Weber et al. | |
| 6,007,188 | A | 12/1999 | MacLeod et al. | |
| 6,162,589 | A * | 12/2000 | Chen et al. | 430/320 |
| 6,264,309 | B1 * | 7/2001 | Sullivan | 347/63 |
| 6,309,054 | B1 * | 10/2001 | Kawamura et al. | 347/65 |
| 6,365,058 | B1 * | 4/2002 | Beatty et al. | 216/27 |
| 6,419,346 | B1 * | 7/2002 | Nikkel | 347/63 |
| 6,582,064 | B2 * | 6/2003 | Cruz-Uribe et al. | 347/63 |
| 6,764,605 | B2 * | 7/2004 | Donaldson et al. | 216/39 |
| 6,866,790 | B2 | 3/2005 | Milligan et al. | |
| 6,896,360 | B2 | 5/2005 | Cox et al. | |
| 6,905,619 | B2 | 6/2005 | Kawamura et al. | |
| 6,910,758 | B2 | 6/2005 | Truninger et al. | |
| 6,916,090 | B2 * | 7/2005 | Valley et al. | 347/93 |
| 2005/0285916 | A1 * | 12/2005 | Koyama et al. | 347/86 |
| 2006/0044353 | A1 * | 3/2006 | Kobayashi | 347/54 |
| 2006/0092246 | A1 * | 5/2006 | Kato et al. | 347/93 |

FOREIGN PATENT DOCUMENTS

JP 2006130742 A * 5/2006

* cited by examiner

*Primary Examiner* — Anita Alanko

(57) ABSTRACT

A method of forming an opening through a substrate includes defining an area on a first surface of the substrate where the opening is to be formed, the area having a center region flanked by edge regions. A top layer having a substantially closed space located over the area is formed on the first surface. Structure for promoting etching of the center region is provided, and the first surface of the substrate is etched in the area. In one embodiment, the method can fabricate an inkjet printhead having a substrate having an ink feed hole formed therethrough and an orifice plate formed thereon. A plurality of particle tolerance elements located over a center region of the ink feed hole promoted etching during the fabrication of the printhead.

9 Claims, 8 Drawing Sheets

METHOD OF FORMING OPENINGS IN SUBSTRATES AND INKJET PRINTHEADS FABRICATED THEREBY

BACKGROUND OF THE INVENTION

This invention relates generally to forming openings in substrates and more particularly to using such techniques to fabricate inkjet printheads.

Inkjet printheads are one of the many types of articles fabricated on silicon wafer substrates using photolithography techniques. A printhead is a drop-generating device having a plurality of nozzles or orifices through which drops of ink are selectively ejected. Ejection of an ink drop through a nozzle is accomplished using any suitable ejection mechanism, such as thermal bubble or piezoelectric pressure wave. One common architecture for a thermal inkjet printhead has a plurality of thin film resistors provided on a semiconductor substrate. An orifice plate is deposited over the thin film layer on the substrate. The orifice plate defines firing chambers about each of the resistors, a nozzle corresponding to each firing chamber, and an ink feed channel fluidly connected to each firing chamber. Ink is provided through an ink feed hole or slot formed in the substrate and flows through the ink feed channels to the firing chambers. Actuation of the resistor by a "fire signal" causes ink in the corresponding firing chamber to be heated and expelled through the corresponding nozzle.

Fabricating such inkjet printheads generally comprises forming an orifice plate on the frontside of a silicon wafer substrate and then forming an ink feed hole in the substrate. One known operation for forming ink feed holes comprises a hybrid laser micromachining and wet chemical etch slotting process. In this hybrid slotting process, a laser micromachining operation makes hardmask openings in a backside oxide layer and then laser micromachines blind trenches in the hardmask openings. The laser trenches must be machined to a specified depth, within a given margin. Next, a wet chemical etch process completes the ink feed holes by etching from both the backside and frontside to meet the final critical dimension (FCD).

While generally providing satisfactory results, this hybrid slotting process does experience occasional yield defects. One common yield defect seen with this process is the so-called "under-etch" defect in which insufficient etching occurs and the ink feed hole fails to meet its final critical dimension (FCD). A major contributor to the under-etch defect is poor frontside etching in the center region of the ink feed hole. Because the frontside etching occurs in the substantially closed chambers formed by the orifice plate, the hydrogen produced by the chemical reaction does not have space to escape and therefore impedes the etching process. Thus, frontside etch only initiates and etches along the edges of the ink feed hole, and the center region experiences minimal etching. As a result, it takes longer for the frontside and backside etches to meet and break through, thereby resulting in more under-etch defects.

Another common yield defect seen with this hybrid process is "laser punch-through" of the orifice plate. That is, breaking through the frontside of the substrate while laser micromachining the backside trench and damaging the orifice plate. The major contributor to laser punch-through of the orifice plate is the laser trench depth being targeted too deep and with small margin. In other words, to achieve desired etching, the backside trench is machined very deep, and thus very close to the frontside of the substrate, which can result in occasional punch through to the orifice plate.

SUMMARY OF THE INVENTION

In one embodiment, the present invention provides a method of forming an opening through a substrate having first and second opposing planar surfaces. The method includes defining an area on the first surface where the opening is to be formed, the area having a center region flanked by edge regions. A top layer having a substantially closed space located over the area is formed on the first surface. Means for promoting etching of the center region are provided, and the first surface of the substrate is etched in the area.

In another embodiment, the present invention provides a method of fabricating an inkjet printhead. This method includes providing a substrate having first and second opposing planar surfaces and defining an ink feed hole area on the first surface. The ink feed hole area has a center region flanked by edge regions. An orifice plate is formed on the first surface, and a substantially closed space is formed in the orifice plate. The space is located over the ink feed hole area. A plurality of etch promoting elements is provided in the space. The etch promoting elements are in contact with the first surface in the center region. The first surface of the substrate in the ink feed hole area is then wet etched.

In still another embodiment, the present invention provides a method of fabricating an inkjet printhead in which a substrate having first and second opposing planar surfaces is provided. A first ink feed hole area is defined on the first surface; the first ink feed hole area has a center region flanked by edge regions. A chamber layer is applied on the first surface, and portions of the chamber layer are removed to define firing chambers and ink feed channels and to form etch promoting elements in the center region. A nozzle layer is applied over the chamber layer, and a plurality of nozzles is formed in the nozzle layer. A second ink feed hole area is defined on the second surface, and a backside trench is machined in the second ink feed hole area. An ink feed hole is formed in the substrate by wet etching the first ink feed hole area on first surface and the second ink feed hole area on the second surface.

The present invention and its advantages over the prior art will be more readily understood upon reading the following detailed description and the appended claims with reference to the accompanying drawings.

DESCRIPTION OF THE DRAWINGS

The subject matter that is regarded as the invention is particularly pointed out and distinctly claimed in the concluding part of the specification. The invention, however, may be best understood by reference to the following description taken in conjunction with the accompanying drawing figures in which:

DETAILED DESCRIPTION OF THE INVENTION

Figure 1:
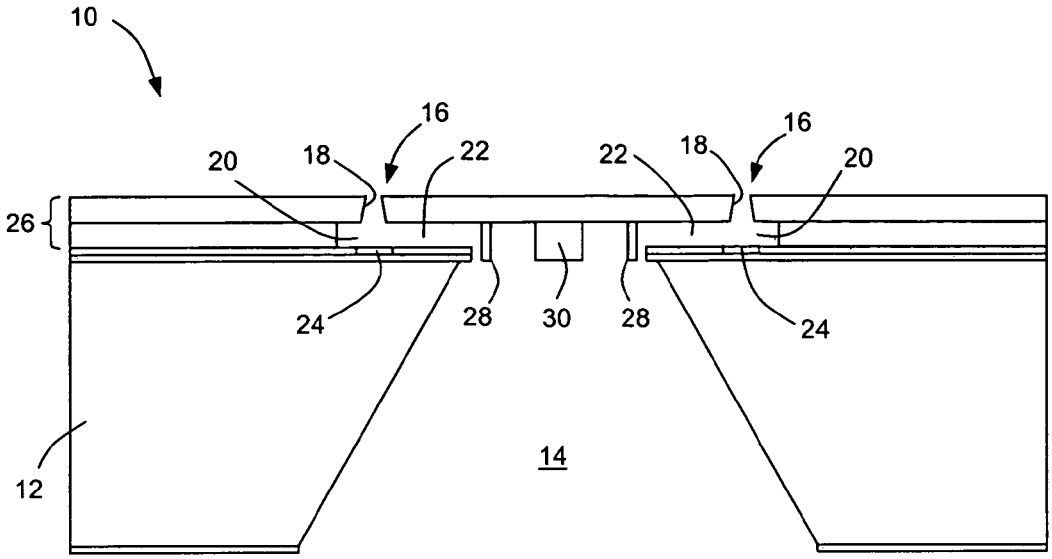
FIG. 1 is cross-sectional side view of a thermal inkjet printhead.

Referring to the drawings wherein identical reference numerals denote the same elements throughout the various views, FIGS. 1-8 illustrate one embodiment of a method for forming an opening through a substrate. Specifically, FIGS. 1-8 depict a process of fabricating a thermal inkjet printhead; wherein the opening formed in a substrate is an ink feed hole. This is simply one possible application of a method for forming an opening through a substrate given by way of example to illustrate the present invention. It should be noted that the process of forming an opening in a substrate can be used in many applications other than fabricating inkjet printheads. In addition, it should be noted that FIGS. 1-8 are schematics for a very small region of a substrate that may be many orders of magnitude greater in dimension to the shown region, and that the various structural features shown for purposes of illustration are not necessarily to scale.

FIG. 1 shows an exemplary inkjet printhead 10 fabricated from the process described below; that is, a finished product of the process. The printhead 10 includes a substrate 12 having at least one ink feed hole 14 formed therein with a plurality of ink drop generators 16 arranged around the ink feed hole 14. Each ink drop generator 16 includes a nozzle 18, a firing chamber 20 in fluid communication with the nozzle 18, an ink feed channel 22 establishing fluid communication between the ink feed hole 14 and the firing chamber 20, and a resistor or similar heating element 24 disposed in the firing chamber 20. It should be noted that while the thermally actuated resistors are described here by way of example, the present invention could include other types of fluid ejection devices such as piezoelectric actuated devices. An orifice plate 26 formed on top of the substrate 12 defines the nozzles 18, the firing chambers 20, and the ink feed channels 22. A plurality of particle tolerance elements 28, 30 are suspended from the orifice plate 26 over the ink feed hole 14. Although FIG. 1 depicts one common printhead configuration, namely, two rows of ink drop generators about a common ink feed hole, other configurations useful in inkjet printing may also be formed in the practice of the present invention.

In operation, ink is introduced into the firing chamber 20 from the ink feed hole 14 (which is in fluid communication with a conventional ink source (not shown)) via the ink feed channel 22. Selectively passing current through the resistor 24 superheats the ink in the associated firing chamber 20 to a cavitation point such that an ink bubble's expansion and collapse ejects a droplet through the associated nozzle 18. The firing chamber 20 is then refilled with ink from the ink feed hole 14 via the ink feed channel 22 for the next operation. The particle tolerance elements 28, 30 operate to trap particles that may be present in the ink and prevent such particles from clogging the ink feed channels 22 and the nozzles 18.

Figure 2:
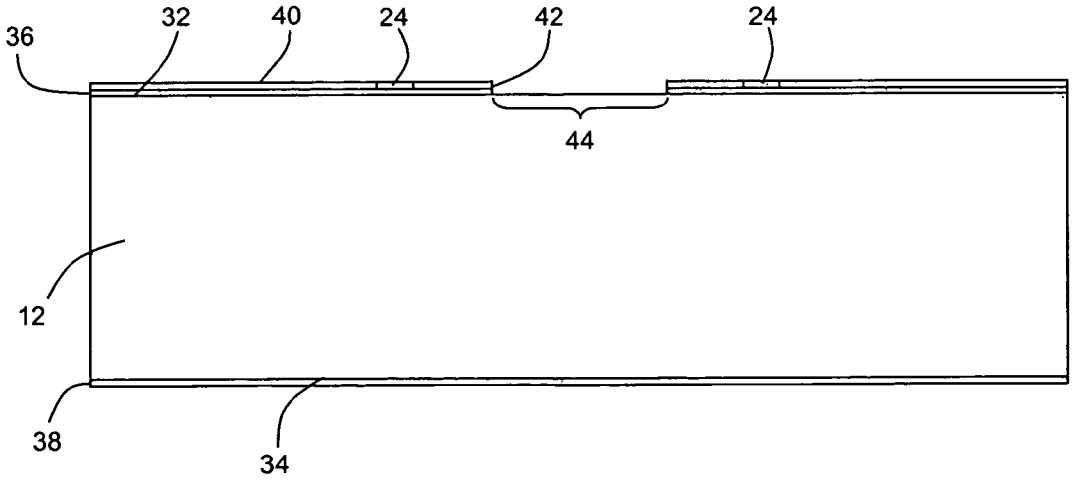
FIG. 2 is a cross-sectional side view of a partially fabricated printhead provided with a frontside ink feed hole area.

Referring now to FIG. 2, the fabrication process starts with a substrate 12, which is typically a silicon wafer. The substrate 12 has a first planar surface 32 (also referred to herein as the frontside surface) and a second planar surface 34 (also referred to herein as the backside surface), opposite the first surface 32. A first oxide layer 36, which can be, for example, a field oxide layer, is grown or deposited on the frontside surface 32, and a second oxide layer 38, which can also be a field oxide layer, is grown or deposited on the backside surface 34. A thin film stack 40 is applied on top of the first oxide layer 36. In one embodiment, the film stack 40, which is generally well known in the art, includes, for example, a conductive metal layer, forming the resistors 24 and conductive traces, and one or more passivation layers. The passivation layers are generally formed, for example, of tantalum, silicon dioxide, silicon carbide, silicon nitride, polysilicon glass, or any other suitable material. The conductive metal layers are generally formed, for example, of aluminum, gold or other metal or metal alloy. The thin film stack 40 and the first oxide layer 36 are patterned and etched using known photolithography techniques to define an opening 42 that delineates an area 44 on the frontside surface 32 of the substrate 12 where the frontside portion of the ink feed hole 14 is to be formed. This area 44 is referred to herein as the ink feed hole area.

Next, the orifice plate 26 (not shown in FIG. 2) is formed on top of the thin film stack 40. The orifice plate 26 is preferably, although not necessarily, formed of a photoimagable epoxy such as SU8 available from several sources including MicroChem Corporation of Newton, Mass. One possible approach to forming the orifice plate 26 includes generating three individual layers: a primer layer, a chamber layer and a nozzle layer. In this approach, a primer layer (not shown) is first applied over the thin film stack 40. In one embodiment, the primer layer can comprise a combination of an adhesion promoter, such as a Silane Coupling Agent (SCA), and a thin layer of material conforming to the material that the orifice plate 26 is to be made from. For example, when the orifice plate 26 is to be made of SU8, this thin layer could be a 2-8 μm layer of SU8 having a low viscosity of about 10-250 centipoise.

Figure 3:
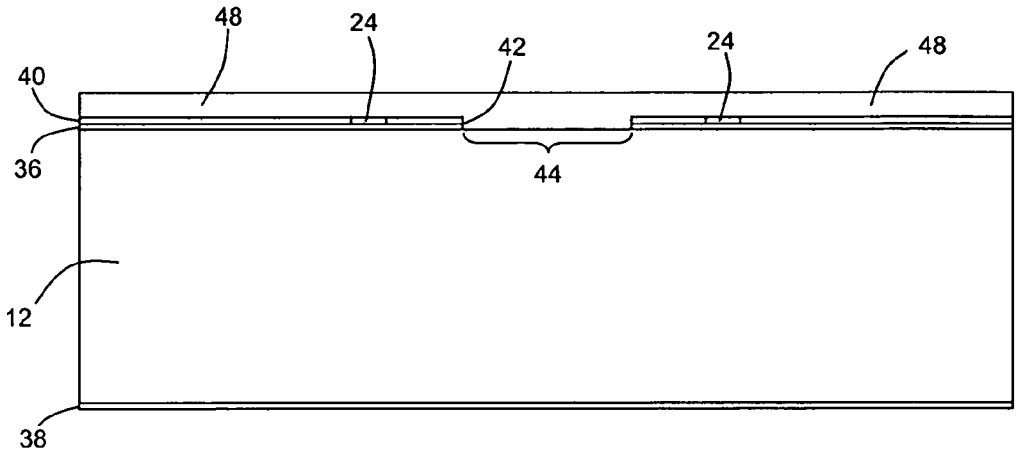
FIG. 3 is a cross-sectional side view of a partially fabricated printhead provided with a chamber layer.
Figure 4:
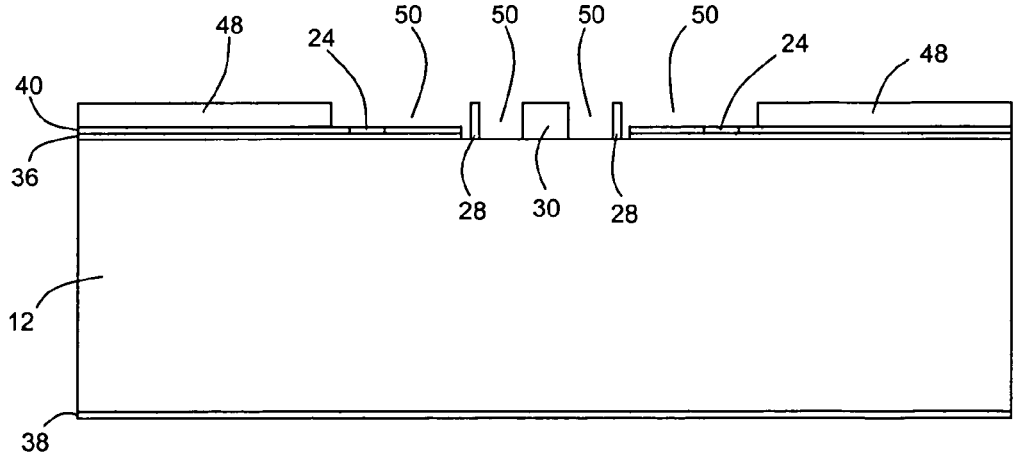
FIG. 4 is a cross-sectional side view of a partially fabricated printhead with portions of the chamber layer removed.
Figure 5:
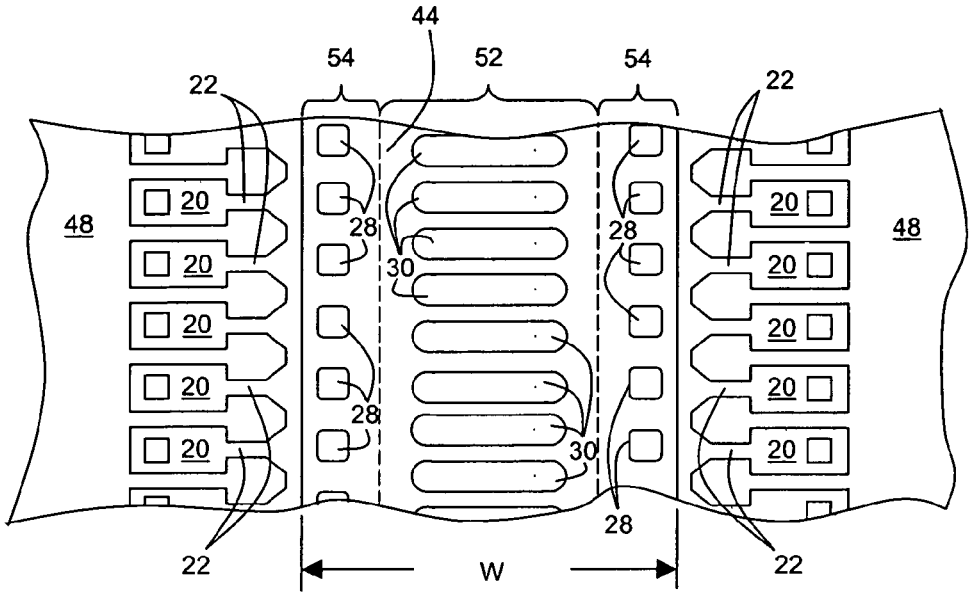
FIG. 5 is a partial top view of the partially fabricated printhead of FIG. 4 showing particle tolerance or etch promoting elements.

As shown in FIG. 3, a chamber layer 48 is then applied over the primer layer (not shown). In one embodiment, the chamber layer 48 can comprise higher viscosity (e.g., viscosity of approximately 2000-4000 centipoise) SU8 that is spun on. The chamber layer thickness varies between about 9-25 μm depending on desired drop size and fluidics performance. The more viscous SU8 allows for thicker coatings and better uniformity. The assembly is baked and then photoimaged using an appropriately formed chamber level mask, which masks the areas of the chamber layer 48 that are to be removed and does not mask the areas that are to remain. The SU8 behaves as a negative photoresist, meaning SU8 remains in areas that are exposed to light. After the light exposure, the chamber layer 48 is developed using an appropriate agent, such as propylene glycol monomethyl ether acetate (PGMEA) or ethyl lactate, to remove the unexposed SU8. That is, the developing agent removes the chamber layer material from areas that did not receive light, thereby creating voids 50 as seen in FIGS. 4 and 5. The voids 50 left from the removed chamber layer material will form the firing chambers 20 and the ink feed channels 22. That is, portions of the chamber layer 48 not removed in the develop step will constitute sidewalls of the firing chambers 20 and the ink feed channels 22, as best seen in FIG. 5.

Portions of the chamber layer 48 overlying the ink feed hole area 44 are also not removed in the develop step so as to form the particle tolerance elements 28, 30. At this point in the process, the particle tolerance elements 28, 30 are upstanding from, and in contact with, the substrate surface in the ink feed hole area 44. As shown in FIG. 5, the ink feed hole area 44 is divided across its width W into a center region 52 and two edge regions 54 flanking the center region 52. The particle tolerance elements thus comprise a number of first particle tolerance elements 28 located in each of the two edge regions 54 and a number of second particle tolerance elements 30 located in the center region 52. The first particle tolerance elements 28 define pillars preferably positioned adjacent a corresponding ink feed channel 22 and will function to trap particles and to prevent clogging of the ink flow channels 22 and the nozzles 18. The second particle tolerance elements 30 located in the center region 52 of the ink feed hole area 44 will also help to trap particles and prevent clogging. As will be described in more detail below, the second particle tolerance elements 30 also function to promote etching of the substrate 12 in the center region 52 during fabrication of the printhead 10.

Figure 6:
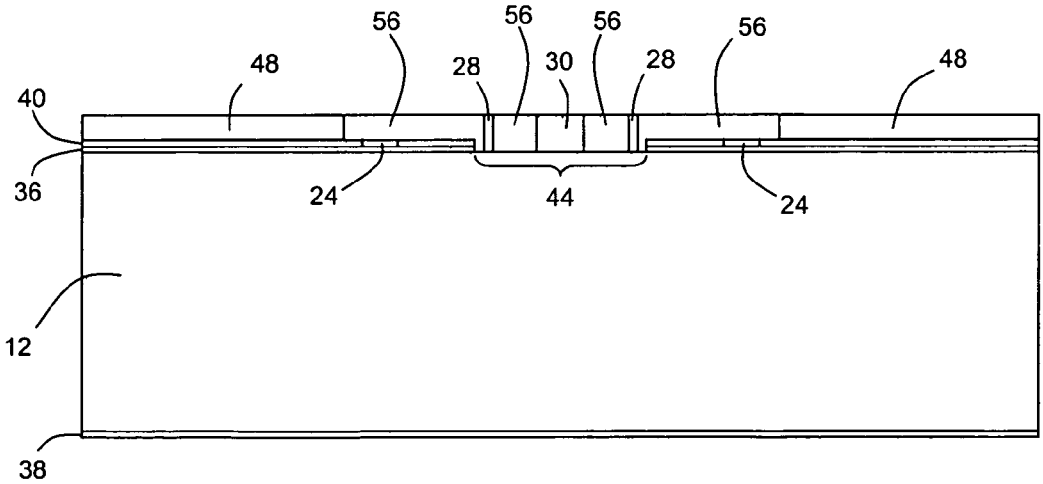
FIG. 6 is a cross-sectional side view of a partially fabricated printhead provided with fill material.

Turning to FIG. 6, a lost wax process is used to preserve the voids 50 (not shown in FIG. 6) during subsequent processing. A fill material 56, such as a standard positive photoresist or an inert fill material, is applied over the chamber layer 48 so as to fill the voids 50. The fill material 56, which initially overfills the voids 50, is then planarized, such as through a resist etch back (REB) process or a chemical mechanical polishing (CMP) process. This planarization process removes excess fill material to bring the fill material 56 in the voids 50 flush with the chamber layer 48.

Figure 7:
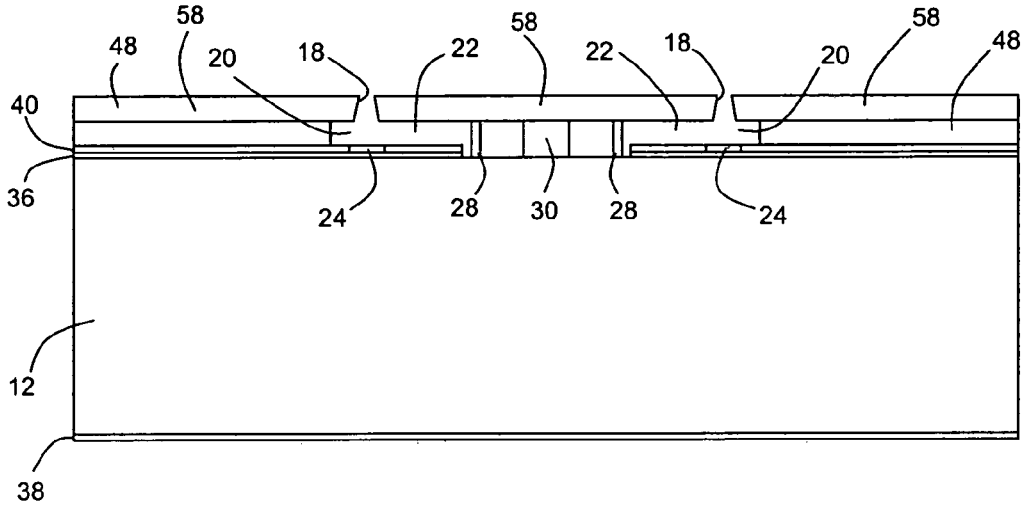
FIG. 7 is a cross-sectional side view of a partially fabricated printhead provided with a nozzle layer.

Referring to FIG. 7, a nozzle layer 58 is applied on top of the chamber layer 48. The fill material 56 holds the shape of the filled voids 50 while the nozzle layer 58 is added. The nozzle layer 58 is preferably, although not necessarily, made of the same material as the chamber layer 48, such as SU8. The nozzle layer 58 is photoimaged using an appropriately formed nozzle level mask. The SU8 behaves as a negative photoresist, meaning SU8 remains in areas that are exposed to light. An appropriate developing agent is used again, this time to remove the areas of the nozzle layer 58 not exposed to light and thereby form the nozzles 18. In addition, the fill material 56 filling the voids 50 in the chamber layer 48 is also removed, leaving the now substantially closed space defining the firing chambers 20, the ink feed channels 22, and the void above the ink feed hole area 44. This space is "substantially closed" in that it is completely enclosed except for the nozzles 18. The primer layer (not shown), the chamber layer 48 and the nozzle layer 58 collectively make up the orifice plate 26, which can also be referred to as the "top layer." The completed structure is cured at elevated temperature (e.g., 150-220° C.) and then exposed to an oxygen plasma ash to clean any residues from the surfaces.

Figure 8:
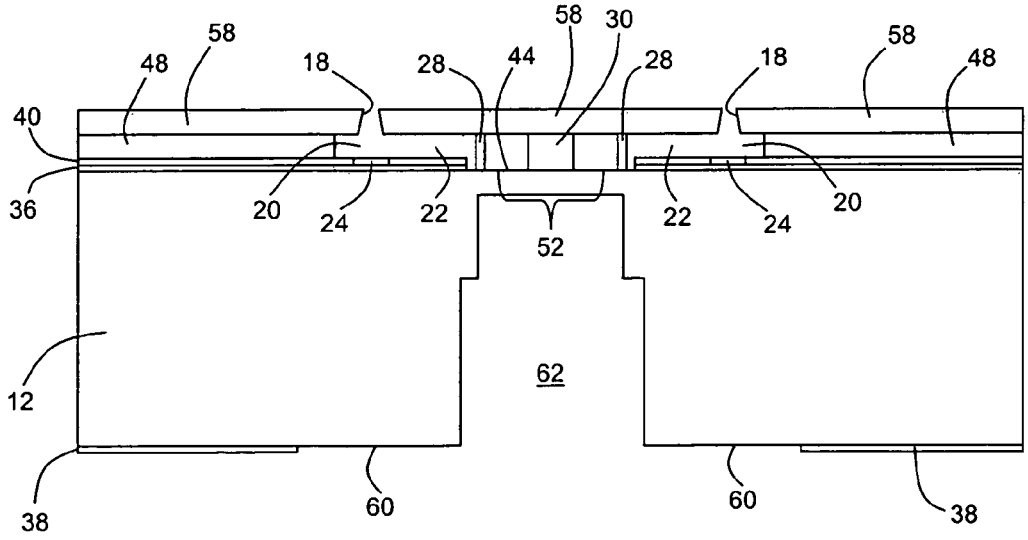
FIG. 8 is a cross-sectional side view of a partially fabricated printhead provided with a backside trench.

Turning to FIG. 8, the next step is to form a backside hard mask in the second oxide layer 38, which determines the desired configuration of the ink feed hole 14 on the backside surface 34. The backside hard mask defines an exposed area on the backside surface 34 referred to herein as the backside ink feed hole area 60. The backside ink feed hole area 60 can be formed through laser ablation of appropriate portions of the second oxide layer 38. A backside trench 62 is then created in the backside ink feed hole area 60 via laser micromachining.

Fabrication of the printhead 10 is completed by removing additional substrate material to produce the final dimension of the ink feed hole 14, as shown in FIG. 1. In one embodiment, the ink feed hole 14 is finished by a combined frontside and backside bulk wet etching process using a wet etchant such as tetramethyl ammonium hydroxide (TMAH), potassium hydroxide (KOH), or the like. The backside etch is accomplished by introducing the etchant to the backside ink feed hole area 60 and the backside trench 62. At the same time, the frontside etch is accomplished by introducing the etchant to the frontside ink feed hole area 44. The etchant flows through the nozzles 18, the chambers 20 and the ink feed channels 22 to reach the ink feed hole area 44. The etchant floods the frontside ink feed hole area 44, surrounding the particle tolerance elements 28, 30, and begins to etch exposed substrate material.

Figure 9:
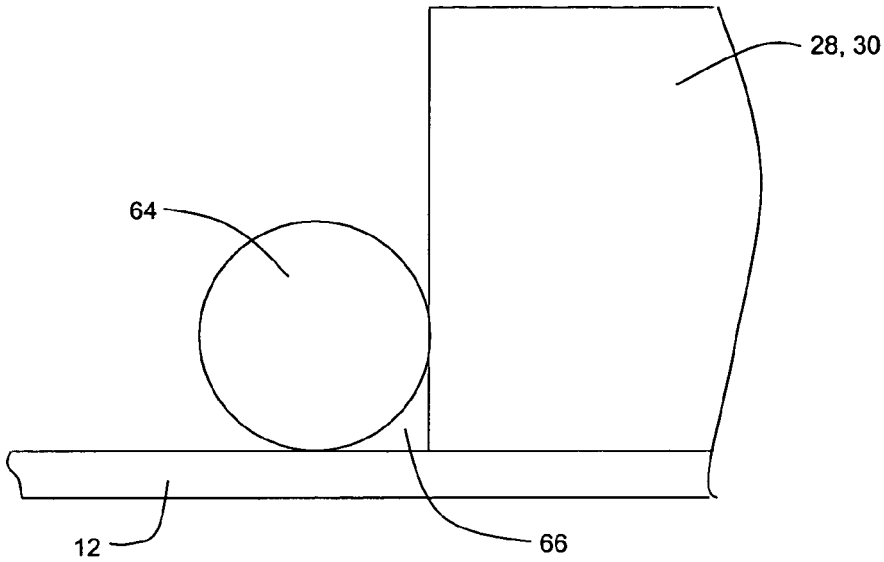
FIG. 9 is an enlarged side view of a printhead showing bubble formation at the interface of a substrate and a particle tolerance or etch promoting element.

The particle tolerance elements 28, 30 initiate and enhance (i.e., promote) etching of the substrate 12 at the locations they contact the substrate 12. This is because the interfaces of the particle tolerance elements 28, 30 and the substrate 12 form a corner that tends to force hydrogen bubbles produced by the chemical reaction away from the etch front. Because the frontside etching occurs in a substantially closed space, the hydrogen bubbles would normally (i.e., without the particle tolerance elements 28, 30) be trapped against the substrate 12 so as to slow etching. However, as shown in FIG. 9, the corner defined by a particle tolerance element 28 or 30 and the substrate 12 prevents hydrogen bubbles 64 from reaching the space 66 adjacent to the interface, thereby allowing fresh etchant to reach the substrate material in the interface space 66. As the hydrogen bubbles grow in size, the interface space 66 becomes larger. Thus, while the substrate 12 is not etched directly below the particle tolerance elements 28, 30, the rest of the substrate surface in the ink feed hole area 44 is etched to a greater degree. The substrate material directly under the particle tolerance elements 28, 30 is eventually removed by the above-mentioned backside etch of the substrate 12. Because they promote substrate etching, the particle tolerance elements 28, 30 are also referred to herein as "etch promoting elements."

Enhanced etching in the center region 52 of the frontside ink feed hole area 44 leads to greater overall frontside etch depth. By way of example, in one embodiment, the second particle tolerance or etch promoting elements 30 cause etching in the center region 52 to reach a depth of 25-30 microns. Without etch promoting elements, but with everything else being equal, the substrate material in the center region of ink feed hole area is only etched about 1 micron in depth. The deeper frontside etch means that the bulk etch of the backside laser trench 62 meets with the frontside etch much earlier than would otherwise occur without the enhanced center region etch. This significantly reduces under-etch defects from the wet etch process. The enhanced center region frontside etch also means that the backside trench 62 does not need to be machined as deep as with conventional processing. Lessening the laser trench target depth reduces occurrences of laser punch-though of the orifice layer. Furthermore, the enhanced center region frontside etch allows increased laser trench depth margin, which in turn increases production yield.

Therefore, the present invention contributes significantly to printhead fabrication yield improvement and subsequently lowers manufacturing costs.

Figure 10:
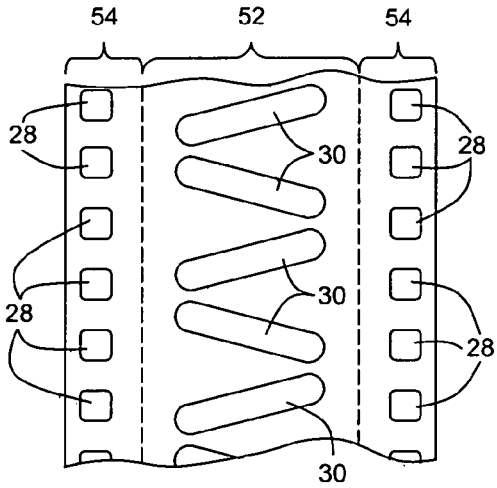
FIG. 10 is a partial top view showing another embodiment of particle tolerance or etch promoting elements.
Figure 11:
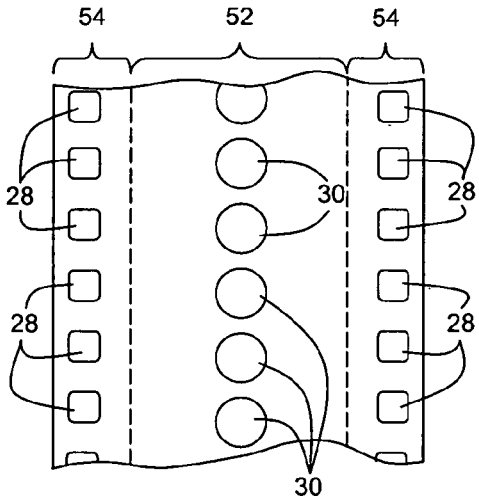
FIG. 11 is a partial top view showing yet another embodiment of particle tolerance or etch promoting elements.
Figure 12:
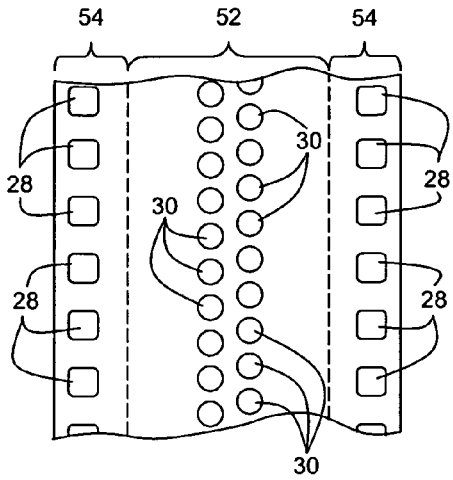
FIG. 12 is a partial top view showing still another embodiment of particle tolerance or etch promoting elements.

The second particle tolerance or etch promoting elements 30 are shown in FIG. 5 as having an oval shape and are aligned (i.e., arranged in a straight line) in the center region 52 in a side-by-side, parallel pattern. This is just one possible configuration. Many other configurations for the etch promoting elements 30 are possible. For instance, FIG. 10 shows an embodiment in which the second etch promoting elements 30 have an oval shape, but are aligned in the center region 52 in a zigzag pattern. FIG. 11 shows another embodiment in which the etch promoting elements 30 define a circular shape and are aligned in a straight line in the middle of the center region 52. In FIG. 12, the etch promoting elements 30 are again circular in shape, but are arranged in two parallel lines in the center region 52. The lines are staggered with respect to one another.

In general, the second particle tolerance or etch promoting elements 30 are designed so as to best promote center region etching while still providing a particle tolerance function in the finished printhead 10. Some general guidelines for designing the etch promoting elements 30 are given below. First, because etching does not occur directly under the etch promoting elements 30, the elements 30 should be as small as possible. Second, the minimum element size and the clear space to the ink feed hole edges should meet relevant manufacturer design rules. Third, the spacing between adjacent etch promoting elements 30 should be optimized. Generally, if this spacing is too small, the etch between adjacent elements 30 will be V-terminated quickly, resulting in a shallow trench. If this spacing is too big, more substrate material between elements will be left behind without etching and overall etch depth will suffer. For one current printhead architecture design, optimum spacing between adjacent elements is about 20 microns. Fourth, the etch promoting elements 30 should be in contact with the substrate surface to be etched. Fifth, because etching initiates only along the element perimeter in contact with the substrate surface, the perimeter of the etch promoting elements 30 should be as long as possible. Sixth, the etch promoting elements 30 should be positioned within the ink feed hole center region 52 so that the ink fluidic dynamitic on the shelf and in the firing chambers will not be affected.

Figure 13:
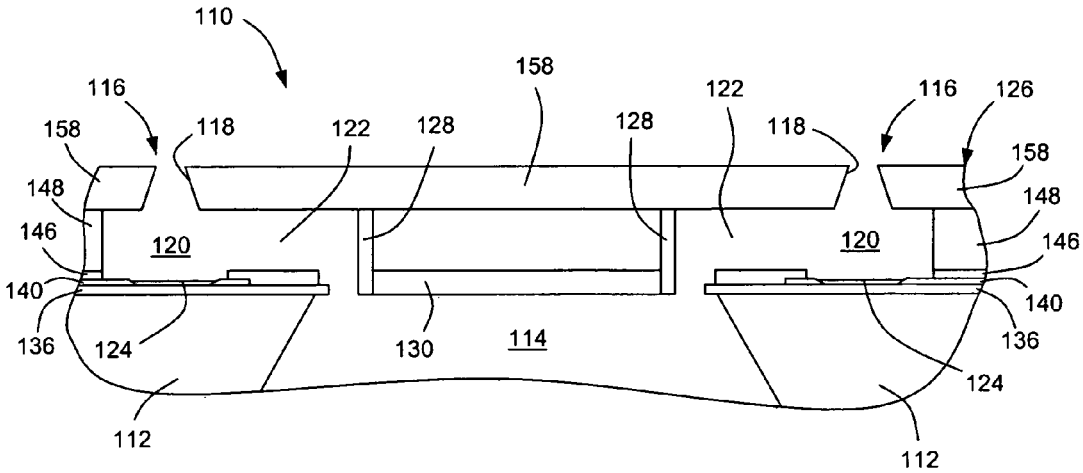
FIG. 13 is cross-sectional side view of a portion of another embodiment of a thermal inkjet printhead.

FIG. 13 shows another embodiment of an inkjet printhead 110 having means for promoting etching. The printhead 110 includes a substrate 112 having at least one ink feed hole 114 formed therein with a plurality of ink drop generators 116 arranged around the ink feed hole 114. Each ink drop generator 116 includes a nozzle 118, a firing chamber 120 in fluid communication with the nozzle 118, an ink feed channel 122 establishing fluid communication between the ink feed hole 114 and the firing chamber 120, and a resistor or similar heating element 124 disposed in the firing chamber 120. As before, it should be noted that while the thermally actuated resistors are described here by way of example, the present invention could include other types of fluid ejection devices such as piezoelectric actuated devices. An oxide layer 136 is formed on the frontside surface of the substrate 112, and a thin film stack 140, providing the resistor 124, is applied on top of the oxide layer 136. An orifice plate 126 comprising a primer layer 146, a chamber layer 148 and a nozzle layer 158 is formed on top of the substrate 112. The orifice plate 126 defines the nozzles 118, the firing chambers 120, and the ink feed channels 122.

Figure 14:
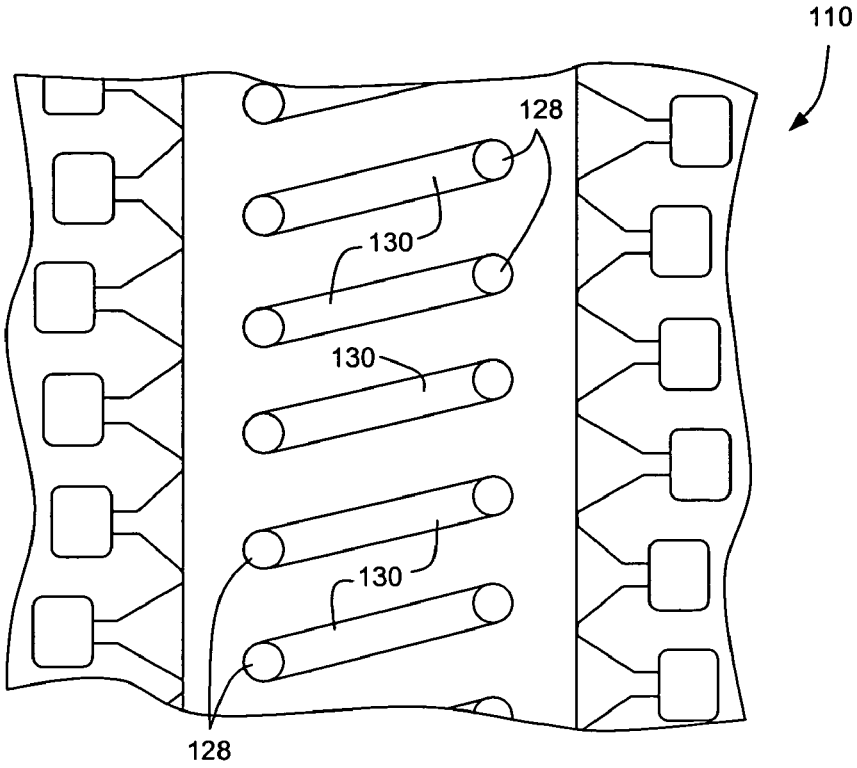
FIG. 14 is a partial top view of the printhead of FIG. 13 showing one configuration of particle tolerance or etch promoting elements.
Figure 15:
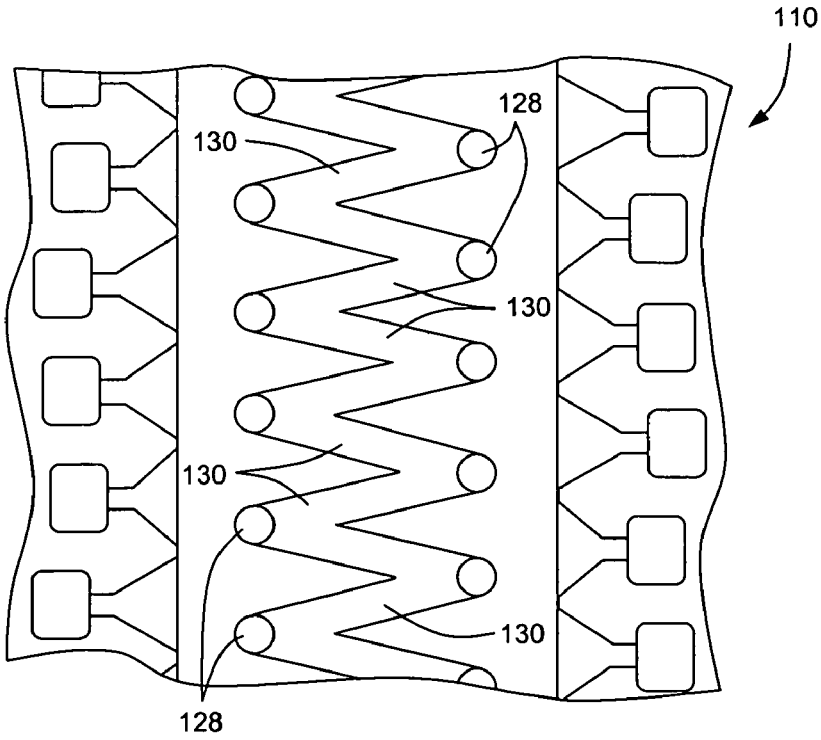
FIG. 15 is a partial top view of the printhead of FIG. 13 showing another configuration of particle tolerance or etch promoting elements.
Figure 16:
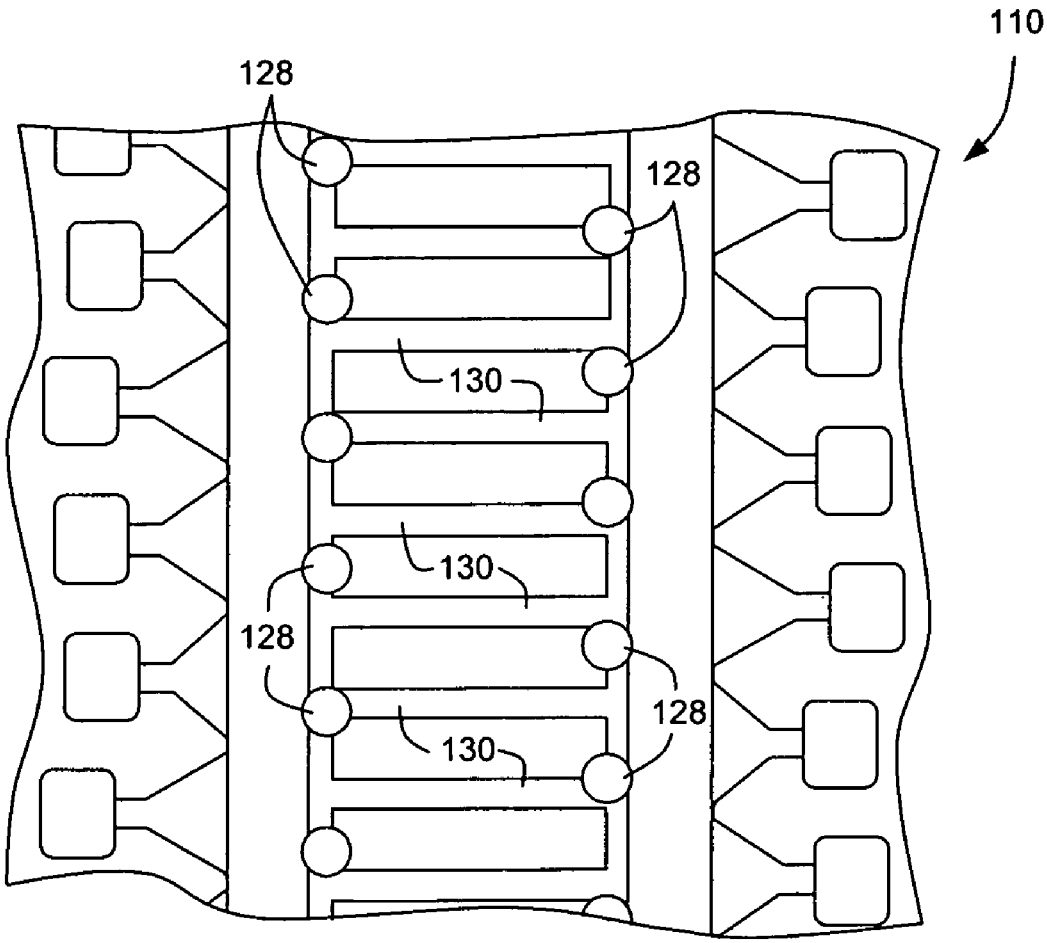
FIG. 16 is a partial top view of the printhead of FIG. 13 showing yet another configuration of particle tolerance or etch promoting elements.

The printhead 110 further includes a plurality of first particle tolerance elements 128 suspended from the orifice plate 126 over the ink feed hole 114, in the same manner as the first particle tolerance elements of the embodiments described above. A plurality of second particle tolerance or etch promoting elements 130 is suspended from the first particle tolerance elements 128. The etch promoting elements 130 extend between the first particle tolerance elements 128 and are primarily formed from the primer layer 146. FIGS. 14-16 show some possible configurations for the etch promoting elements 130. Specifically, FIG. 14 shows discrete etch promoting elements 130, where each etch promoting element 130 extends between a corresponding pair of first particle tolerance elements 128 on opposite sides of the ink feed hole 114. FIG. 15 shows the etch promoting elements 130 zigzagging between the first particle tolerance elements 128. FIG. 16 shows etch promoting elements 130 in the form of a grid extending along and between the first particle tolerance elements 128.

While specific embodiments of the present invention have been described, it will be apparent to those skilled in the art that various modifications thereto can be made without departing from the spirit and scope of the invention as defined in the appended claims.

What is claimed is:

1. A method of fabricating an inkjet printhead, said method comprising:

providing a substrate having first and second opposing planar surfaces;

defining an ink feed hole area on said first surface, said ink feed hole area having a center region flanked by edge regions;

forming an orifice plate on said first surface;

forming a substantially closed space in said orifice plate, wherein said space is located over said ink feed hole area;

forming a plurality of particle tolerance elements in said space, the particle tolerance elements in contact with said first surface in said center region, at least some of the particle tolerance elements configured to promote etching of the substrate within the center region; and wet etching said first surface of said substrate in said ink feed hole area.

2. The method of claim 1 wherein defining an ink feed hole area comprises forming an oxide layer on said first surface and removing a portion of said oxide layer to define said ink feed hole area.

3. The method of claim 1 further comprising forming a plurality of particle tolerance elements in said edge regions.

4. The method of claim 1 further comprising wet etching said second surface of said substrate.

5. The method of claim 4 further comprising forming a trench in said second surface of said substrate and wet etching said second surface.

6. A method of fabricating an inkjet printhead, said method comprising:

providing a substrate having first and second opposing planar surfaces;

defining a first ink feed hole area on said first surface, said first ink feed hole area having a center region flanked by edge regions;

applying a chamber layer on said first surface;

removing portions of said chamber layer to define firing chambers and ink feed channels and to form etch promoting elements in said center region;

applying a nozzle layer over said chamber layer;

forming a plurality of nozzles in said nozzle layer;

defining a second ink feed hole area on said second surface;

machining a backside trench in said second ink feed hole area; and forming an ink feed hole in said substrate by wet etching said first ink feed hole area on first surface and said second ink feed hole area on said second surface.

7. The method of claim 6 wherein said etch promoting elements are in contact with said first surface in said center region.

8. The method of claim 6 wherein defining said first ink feed hole area comprises forming an oxide layer on said first surface and removing a portion of said oxide layer to define said first ink feed hole area.

9. The method of claim 6 further comprising forming a plurality of particle tolerance elements in said edge regions.

* * * * *